US005197848A

United States Patent [19]

Musil et al.

[11] Patent Number: 5,197,848

[45] Date of Patent: Mar. 30, 1993

[54] METHODS OF AND APPARATUS FOR TRANSFERRING MATERIALS

[75] Inventors: Joseph E. Musil, Ely; Jon D. Goodwin, Cedar Rapids, both of Iowa

[73] Assignee: Cedarapids, Inc., Cedar Rapids, Iowa

[21] Appl. No.: 850,512

[22] Filed: Mar. 13, 1992

Related U.S. Application Data

[60] Division of Ser. No. 730,371, Jul. 11, 1991, Pat. No. 5,100,277, which is a continuation of Ser. No. 448,057, Dec. 8, 1989, abandoned.

[51] Int. Cl.[5] ..... B65G 67/02

[52] U.S. Cl. ..... 414/786

[58] Field of Search ..... 414/786, 334, 339, 343, 414/346, 350-352, 386, 389, 401, 489, 518, 523, 528; 404/108, 110, 72, 75

[56] References Cited

U.S. PATENT DOCUMENTS

| | | | |
|---|---|---|---|
| 701,902 | 10/1902 | Smith et al. | 431/330 |
| 1,258,299 | 3/1918 | Bayley | 404/95 |
| 1,445,084 | 5/1918 | Joy | 198/514 |
| 2,195,221 | 12/1938 | Millikin | 404/92 |
| 2,282,704 | 9/1939 | Butters | 414/528 X |
| 2,636,628 | 4/1953 | Prang | 414/489 |
| 3,000,649 | 1/1961 | Heer et al. | 414/343 X |
| 3,034,410 | 5/1962 | Ross et al. | 404/108 |
| 3,250,191 | 5/1966 | Potts | 404/108 |
| 3,267,824 | 8/1966 | Hudis | 404/108 X |
| 3,479,755 | 11/1969 | Schropp | 404/101 X |
| 3,608,446 | 9/1971 | Plant | 414/343 X |
| 3,647,096 | 3/1972 | Holland | 414/528 |
| 3,670,909 | 6/1972 | Holland | 414/350 |
| 3,693,512 | 9/1972 | Smith | 414/101 |
| 3,719,298 | 3/1973 | Brown | 414/489 |
| 3,828,859 | 8/1974 | Alvarez | 404/92 X |
| 4,290,820 | 9/1981 | Swisher, Jr. et al. | 134/6 |
| 4,332,505 | 6/1982 | Mauldin | 404/108 |
| 4,357,129 | 11/1982 | Luttig | 414/346 |
| 4,717,307 | 1/1988 | Ciuffetelli | 414/343 X |
| 4,781,466 | 11/1988 | Zimmerman | 414/343 X |
| 4,783,171 | 11/1988 | Zimmerman | 414/343 X |
| 4,795,264 | 1/1989 | Riker | 414/528 X |
| 4,818,139 | 4/1989 | Brock et al. | 404/108 X |
| 4,923,355 | 5/1990 | Mancini | 414/343 X |
| 5,002,453 | 3/1991 | Shigehisa | 414/528 X |
| 5,015,120 | 5/1991 | Brock et al. | 414/518 X |
| 5,100,277 | 3/1992 | Musil | 414/334 |

FOREIGN PATENT DOCUMENTS

| | | | |
|---|---|---|---|
| 378784 | 6/1964 | Switzerland . | |
| 311837 | 10/1971 | U.S.S.R. | 414/489 |
| 814834 | 3/1981 | U.S.S.R. | 414/489 |

*Primary Examiner*—David A. Bucci

*Attorney, Agent, or Firm*—Simmons, Perrine, Albright & Ellwood

[57] ABSTRACT

A material transfer machine includes a slat conveyor of substantially the width of a feed hopper of a paving machine. The slat conveyor is supported by caster wheels to be disposed at an incline having a material intake end at a lower end thereof and a discharge end at the opposite upper end of the conveyor. The slat conveyor is mounted to a leading edge of the paving machine such that the upper discharge end is disposed above the feed hopper of the paving machine. A hopper is disposed ahead of the lower intake end of the slat conveyor, supported by a frame which is pivotably attached at a rear end thereof along the sides of the slat conveyor to an understructure thereof. The front end of the frame is supported by caster wheels, such that the frame is capable of joint movement with the conveyor and the paving machine while supporting pivotal movement in a vertical plane in response to grade changes of a base grade. Material is transferred from beds of supply trucks by backing the trucks toward the leading edge of the hopper to align the rear of the beds with the hopper. The material is dumped into the hopper and is transferred by the slat conveyor directly from the hopper of the material transfer machine to the feed hopper of the paving machine without getting into contact with the base grade of the road being paved.

6 Claims, 4 Drawing Sheets

METHODS OF AND APPARATUS FOR TRANSFERRING MATERIALS

This is a division of copending application Ser. No. 07/730,371 filed on Jul. 11, 1991, now U.S. Pat. No. 5,100,277, which is a continuation of application Ser. No. 07/448,057, filed Dec. 8, 1989, now abandoned.

BACKGROUND OF THE INVENTION

1. Field of the Invention

The invention relates generally to methods of and apparatus for transferring materials. More particularly, the invention relates to methods of and apparatus for supplying a paving machine with paving material, such as an asphaltic material.

2. Discussion of the Prior Art

In the art of paving large surfaces such as airport runways, automobile parking lots and various types of roadways with asphaltic aggregate materials, paving machines of the floating screed type have been perfected to lay a path of a typical width of a roadway, typically of between ten to twenty feet in a continuous operation. In fact, the advance of the paver at a preferably constant rate is desirable. Stopping the paver in its operation for any reason, including loading material into its supply hopper, is likely to cause the screed to settle from its normally floating position into the newly laid width of material to result in a grade or density variation and in possibly permanent pavement imperfections. It is therefore desirable to supply the paver with paving materials, typically asphaltic aggregate materials, to enable the paver to proceed at a constant rate in its paving operation. Trucks are typically used to haul loads of the paving material from a mixing site to the current paving site.

A known method to supply the materials to the paver is by allowing the trucks to dump the material to form a windrow along the centerline of the strip of pavement to be laid down by the paver. A windrow elevating machine may be mounted to the front of the paver to be pushed along by the paver. As the paver advances, the elevating machine scoops up the material from the base grade of the roadway and transfers the material by means of a chain conveyor, also referred to as slat conveyor, to the feed hopper of the paver. The windrow supply method entails some shortcomings. Obviously, the amount of material in the windrow needs to equal the amount of material to be laid down by the paving operation. Consequently, the material dump needs to be controlled. Proper spacing between successive truck loads depends on the amount of material each of the trucks is carrying. An excess of material quickly shows up in a filled feed hopper of the paver. Removing material ahead of the paver requires time and possibly results in an undesirable stoppage of the paving operation. On the other hand, a shortage of material may also result in a stoppage of the paving operation, the windrow ahead of the paver making it now more difficult to supply additional material to the paver. Other difficulties which may be experienced is that base grade material may be scooped up by the windrow elevating machine, possibly resulting in a defect in the pavement. Yet, many experienced paving contractors consider the windrow material deposit method to be an overall cost effective paving method.

An alternative to a windrow material deposit method for paving an asphalt roadway is a direct truck dump supply method. According to this alternative method, the truck is backed toward the paver and comes to rest against a truck roll at the front edge of the feed hopper of the paver. The paver then pushes the truck along as the truck unloads the material into the feed hopper of the paver. The typical height of a truck bed and a lack of overhang of its end prevent a truck dump from filling the feed hopper of the paver to a maximum capacity. A feed hopper with a maximum capacity of approximately fifteen tons of asphaltic aggregate material may, for example, only be loaded to a capacity of from 5 to 6 tons of material from an unloading truck. Assuming a fast yet reasonable paving speed of 60 feet per minute, and assuming that a strip three inches thick and fourteen feet wide is paved, an estimated fourteen tons of material per minute is required. The required supply rate allows less than 30 seconds for a truck exchange, a condition which is hardly achievable. A windrow elevating machine, in comparison, has a capability of scooping up and loading a maximum of 2000 tons of material per hour into the feed hopper of the paver, resulting in a continued preference for using the windrow method of providing material whenever possible.

It has been sought to overcome disadvantages of windrow supply methods and direct truck dump methods by a self-propelled storage vehicle of paving material. The vehicle has a hopper with a storage capacity approximately equal to the capacity of one of the material supply trucks. A high capacity slat conveyor similar to the conveyor used by the above-discussed windrow elevating machine allows the truck to dump the material and transfer the material into the hopper of the storage vehicle. The material is then transferable from the hopper to the feed hopper of the paver by a second conventionally pivotable conveyor. Because the second conveyor is capable of elevating the material from the hopper of the storage vehicle to a discharge point above the feed hopper of the paver, the feed hopper of the paver can be filled to the maximum capacity of approximately 15 tons of paving material.

Though each of the discussed methods and associated apparatus for supplying paving material to a paver may solve some of the problems associated with one of the other methods, each method itself has limitations which may not be encountered when using one of the other methods or apparatus. One of the limitations of the added storage vehicle is an added cost factor resulting from the additional, substantial apparatus and the additional personnel needed to operate and maneuver the storage vehicle. Another factor introduced by the storage vehicle is a recognized problem of material separation. Aggregate materials are known to separate into more and less coarse aggregates as the material is transferred from one storage medium to another. A slight degree of separation may be acceptable as unavoidable but is nevertheless undesirable. It is therefore advantageous to minimize separation and reclassification of aggregate materials.

SUMMARY OF THE INVENTION

It is an object of the present invention to alleviate problems traditionally associated with the windrow method of supplying paving materials to a paver while maintaining advantages associated with such a method.

It is another object of the invention to provide methods and apparatus for cost effectively supplying paving materials to a paver.

It is a further object of the invention to minimize characteristic material separation associated with material transfer from supply trucks to a paver.

It is another object of the invention to supply quality material at an efficient and cost effective rate to a paver.

According to the invention, a material transfer machine comprises a slat conveyor including intake and discharge ends, a support structure for attaching the slat conveyor to the front end of a paver and for maintaining a fixed relationship between the paver and the slat conveyor in their plan view. A support frame peripherally embraces the intake end of the slat conveyor. The support frame is pivotally attached on each side of the support structure of the slat conveyor and extends forward therefrom and across the forward end of the slat conveyor. A material dump hopper is supported by the support frame forward of and adjacent the intake end of the slat conveyor.

A method of transferring material from a bed of a supply truck to a feed hopper of a road finishing machine includes mounting a material transfer machine to a front end of the road finishing machine, with a discharge end of the material transfer machine disposed above a feed hopper of the road finishing machine. Material is dumped from the bed of the supply truck into a hopper disposed at a front end of the material transfer machine. The material is then transferred in a single transfer operation from the hopper at the front end of the material transfer machine to the discharge end thereof. Then, the material is discharged by gravity into the feed hopper of the road finishing machine.

BRIEF DESCRIPTION OF THE DRAWINGS

The Detailed Description of the Invention including a detailed description of a preferred embodiment thereof will be best understood when read in reference to the accompanying drawings wherein.

DETAILED DESCRIPTION OF THE INVENTION

Figure 1:
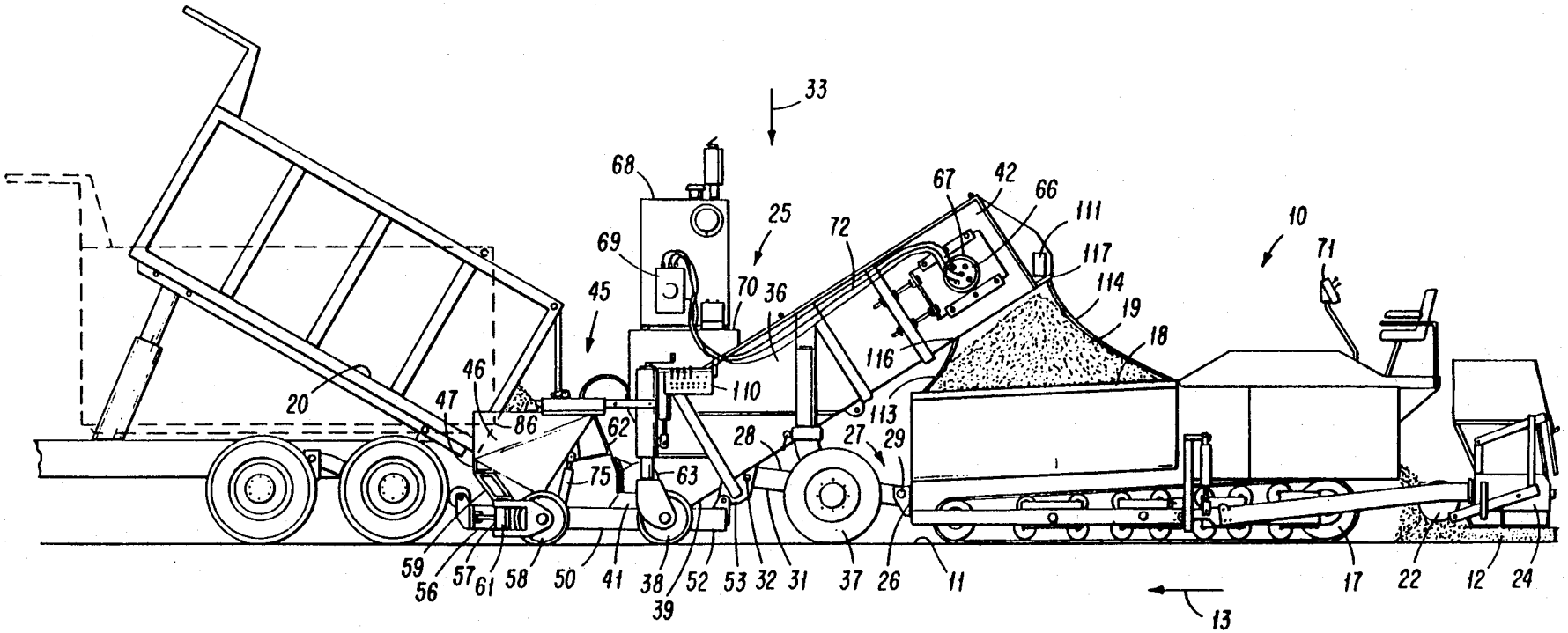
FIG. 1 is a simplified side elevational view of a paver in combination with a material transfer machine depicting a preferred embodiment of the invention.

FIG. 1 shows a side elevation of a road finishing machine, and in particular a typical paving machine or paver 10 in the process of advancing along a base grade 11 of a roadway or the like onto which a layer 12 of pavement is to be deposited. The direction of advance of the paver 10 is as indicated by the arrow 13, such that references to front or rear ends of apparatus or forward or backward directions are in reference to the direction of travel of the paver 10. The paver 10 as a state of the art asphaltic aggregate material paver of the floating screed type includes a wheeled or endless track frame 17, a frame 17 of the endless track type being shown. On such frame 17, there is supported a front material feed hopper 18. The hopper 18 is typically of a width to accept material 19 from a discharge end of a bed 20 (such as shown on the left of FIG. 1) of a typical supply truck. Typically, slat conveyors located in the base of the feed hopper 18, hence not identifiable in the side elevation of the paver, advance the material 19 from the hopper 18 to the rear of the paver 10. In the rear of the paver 10, an auger assembly 22 distributes the material 19 transversely to the direction of travel of the paver 10, just ahead of a rearmost tamper and floating screed assembly 24. The floating screed assembly 24 compacts the material 19 substantially to an acceptable density and grade in accordance with known paving practices. Final finishing of the pavement layer 12 is then achieved in typical rolling operations with equipment which is not part of or directly related to the invention as described herein.

The paver 10 is preceded by a material transfer machine 25, also referred to as direct dump material transfer and elevating apparatus or machine, which represents a preferred embodiment of the present invention. The material transfer machine or apparatus 25 is removably attached to a front end 26 of the paver 10 through a push bar assembly 27. The push bar assembly includes a pair of parallel, spaced longitudinal push bars 28 which are hingedly attached to the front end 26 with a removable pin 29. The front end 31 of each of the push bars 28 is pivotally pinned to the material transfer machine 25 at 32. Thus, viewed in a direction from above the paver 10 and transfer machine 25 as indicated by arrow 33, such view also known and referred to as plan view, the transfer machine 25 is directionally aligned and fixed with respect to the paver 10.

A chain or slat conveyor 36 functions as material transfer element of the material transfer machine 25. Slat conveyors are known in the art as high capacity material transfer elements. For example, the slat conveyor 36 and the manner in which it is disposed with respect to the paver 10 are similar to a slat conveyor of what is known as a windrow pickup machine. The slat conveyor of such a prior art windrow pickup machine is also attachable to the front end of a paver 10. The lower end of the slat conveyor of such a windrow pickup machine is equipped with scoop-like guides which scoop the windrow of material into the lower intake end of the conveyor of such a prior art windrow machine, as the paver 10 advances along its path.

The slat conveyor 36 is supported by a set of rear main wheels 37 and a set of front stabilizing wheels 38. The wheels of each set are mounted to either side of a wide, flat base 39 of the slat conveyor 36. To allow the paver 10 to maneuver when the material transfer machine 25 is mounted to the front end 26, both sets of wheels 37 and 38 are caster wheels which allow the material transfer machine 25 to be translated laterally or transversely to the primary, forward direction of the paver 10. The main wheels are disposed about midway of the length of the slat conveyor 36. The height of the main wheels 37 is fixed with respect to the conveyor 36. The front wheels 38 are disposed adjacent a lower intake end 41 of the slat conveyor 36. As a matter of versatility, such as adjustment to different models of the paver 10, the front wheels 38 of the slat conveyor 36 are vertically adjustable with respect to the conveyor. Thus, as the front wheels 38 are raised with respect to the lower intake end 41 of the conveyor 36, such end 41 becomes disposed closer to the base grade 11. An upper discharge end 42 of the slat conveyor 36, in pivoting about the main wheels 37, is raised with respect to the base grade. In normal operation, the main wheels 37 and the stabilizing wheels establish the orientation of the conveyor 36 at a predetermined incline with respect to the base grade. A lowering or raising of the discharge end 42 of the conveyor 36 may be desirable or even necessary to provide clearance for a feed hopper of a paver 10.

A material dump hopper 45 assembly is disposed at the lower intake end 41 of the slat conveyor and extends forward of the end 41. A hopper 46 of the hopper assembly 45 has a width which accepts the widths of truck beds 20, such as shown in FIG. 1, of typical dump trucks. It has been found that the hopper assembly 45 not only needs to support the weight of the material that may at any time be in the hopper 46, but must support the force of the material dump. Thus, as a truck, having backed its bed 20 over a leading edge 47 of the hopper 46, raises the bed, the material 19 slides under force of gravity out of the truck bed and into the dump hopper 46. Consequently gravitational forces to which the hopper is exposed vary widely. The hopper 46 includes a base 48 which slopes toward the rear downward toward the lower intake end 41 of the slat conveyor 36 to funnel the material 19 toward the lower intake end 41. Sloping side wall portions 49 of the hopper 46 guide the received material 19 transversely inward toward the lower intake end 41.

The hopper assembly 45 consequently includes a support frame 50 which is capable of receiving and sustaining the impact of the material 19 as it slides from the bed 20 as shown in FIG. 1. The frame is substantially "U" shaped, having longitudinally extending members on both sides of the lower intake end 41 of the slat conveyor 36. A significant feature of the support frame is that it is capable of pivotal movement in a vertical plane through a centerline 51 (see FIG. 3) of the material transfer machine 25. Though pivotably mounted as described herein, the frame 50 is disposed in a generally horizontal plane in parallel to the base grade 11. Again in reference to FIG. 1, a rear end 52 of the support frame 50, representing the open end of the "U", is pivotally attached on both sides of the slat conveyor 36 to understructure 53 of the material transfer machine 25. Such rear attachment of the support frame 50 is advantageously located between the main and stabilizing wheels 37 and 38, such that the support of the rear end 52 of the support frame 50 is distributed between the main and the stabilizing wheels of the material transfer machine 25. From such point of attachment at 53, the support frame 50 extends toward the front of the machine 25. A front end 56 of the support frame 50 includes a cross member 57, representing a base of the "U", which supports at outer ends thereof front caster wheels 58. A forward support member 59 of the frame 50 forms a platform which supports the leading edge 47 of the hopper 46. The front edge 47 of the hopper 46 is, consequently, supported through the support frame 50 by the front caster wheels 58. A typical orientation of the front caster wheels 58 is one in which the wheels are trailing behind their respective pivot axes 61. Such an orientation enables the front caster wheels to support a major component of the impact force generated by the material being dumped from the truck bed 20 into the hopper 46. A rearward end 62 of the hopper 46 is pivotally supported from a lower return shaft 63 of the slat conveyor 36. This distributes a rearward directed force component resulting from the material being dumped into the hopper 46 to be supported by the stabilizing wheels 38. The ability of the frame 50 to pivot in the vertical plane further adapts the material transfer machine 25 to respond to grade changes without notable weight distribution among the three sets of caster wheels 37, 38 and 58.

The operation of the material transfer machine 25 is simplified by its attachment to the front of the paver 10, making the directional control and motion in the horizontal slave to the motion of the paver 10. The slat conveyor 36 is preferably powered, as is typical with state of the art equipment of this type, by hydraulic drive means. Two hydraulic motors 66 (only one of which being shown), one on each side of an upper return end 67 of the conveyor 36, are preferably powered by means of an engine 68 and a pump and hydraulic system 69 supported by a platform 70 above and to the rear of the stabilizing wheels 38. The location of the engine 68 advantageously distribute the weight thereof among the stabilizing and rear wheels 37 and 38.

In an alternate mode of operation, and because the material transfer machine 25 is attached as a slave to the paver 10, it is possible to power the hydraulic components of the material transfer machine by typical hydraulic systems on the paver 10, as evident from a hydraulic control panel 71 of the paver 10. This is accomplished by simply coupling hydraulic lines, such as lines 72, to hydraulic couplings on the paver 10 instead of to the hydraulic system 69. A preferred mode of operation, however, is to independently power the material transfer machine 25 with the hydraulic pump and system 69 driven by the engine 68.

Figure 2:
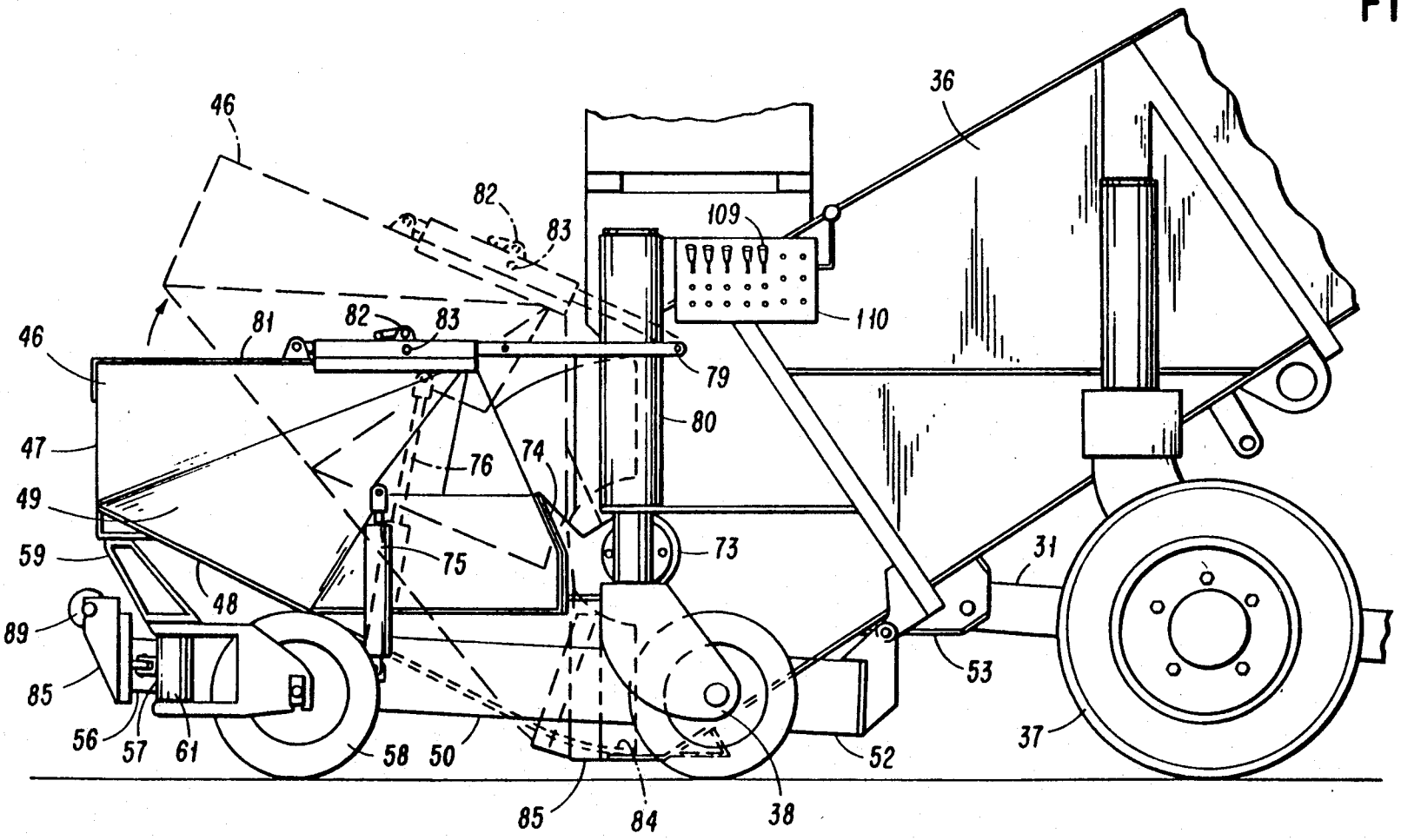
FIG. 2 is a partial side elevational view of the material transfer machine shown in FIG. 1, showing particular features of the invention in greater detail.

FIG. 2 shows a forward portion of the material transfer machine 25 on a larger scale illustrating some of the elements in greater detail. Pivot mounting brackets 73 are pivotally supported on each end of the return shaft 63 of the slat conveyor 36. The brackets 73 are bolted to respective outer ends of the rear wall 74 of the hopper 46 to support a pivot movement of the hopper 46 about the return shaft 63. Since the material transfer machine is preferably provided with the hydraulic system 69, a preferred manner of pivoting the hopper 46 into a raised position is by means of hydraulic cylinders 75 which are mounted on each side of the hopper assembly 45 between the support frame 50 and the hopper 46. As a piston 76 of the hydraulic cylinder 75 extends, the hopper 46 pivots about the lower return shaft 63 to a raised position as shown in FIG. 2 by an alternate position of the hopper 46. A set of top support braces 78 are pivotally mounted at 79 on each side of the material transfer machine 25 to respective vertical support and extension cylinders 80 of the stabilizing wheels 38 and extend forward from the pivot mount 79 toward top edges 81 of the hopper 46. A latch and pin arrangement 82 at the top edges 81 of the hopper 46 enable the hopper to be secured in the raised position without support from the hydraulic cylinder 75. As the hopper 46 is raised, the distance between the latch and pin arrangement 82 and the pivot mount 79 becomes foreshortened and apertures 83 in each of the braces 78 become aligned with and locked to the latch and pin arrangement 82. Thus, once the hopper 46 is urged into the alternate, raised position as shown in FIG. 2 and is supported in the raised position by the braces 78, the hopper will stay in the raised position even though the hydraulic system is shut down. The latch is consequently of significant for service procedures of the material transfer machine 25, or in disassembling the machine to transport it between job sites.

While the hopper 46 has the capability of pivoting movement as described herein, during normal operation of the material transfer machine 25 the raising and lowering of the hopper is not contemplated. During normal paving operations, the asphaltic aggregate material which is dumped from the truck beds 20 is at an elevated temperature and is appropriately flowable to slide down along the base of the hopper 46 into the grasp of the intake end of the slat conveyor 36. In the course of a continuous paving operation, as soon as one of the supply trucks has driven away from the hopper 46, a next truck is in the process of backing toward the advancing paver 10 and transfer machine 25. If any material was left in the hopper from the preceding supply truck, a subsequent dump of additional material now forces the former material into the intake end 41 of the slat conveyor 36. The hopper 46 may be pivoted at the end of a run, when it is desired to clean out remaining material from the hopper before the transfer machine 25 and the paver 10 are shut down. Also, in marginally cold weather it may be desired to raise and lower during the time interval while one truck is driving away from the material transfer machine 25 and before the next truck backs into position in front of the hopper 46. Such a raising would cause any remaining material to slide into the intake end 41 of the slat conveyor 36 to be transferred to the paver feed hopper 18 without having a chance to cool to an undesirably low temperature.

The raising and lowering of the hopper 46 changes the position of a rear pan 84 of the hopper 46 with respect to the lower intake end 41 of the slat conveyor 36. To prevent a gap to occur between the lower intake end 41 of the slat conveyor 46 and the rear pan 84 of the hopper 46, a base pan 85 is attached along the vertical sides of the intake end 41 of the slat conveyor to extend across its width. The base pan 85 accepts the rear pan 84 with substantially the curvature of the outer path of the slats of the slat conveyor 36. The base pan 85 extends forward ahead of the lower intake end 41 of the slat conveyor 36 by an distance to provide a sufficient overlap with the rear pan 84 of the hopper 46 when it is in the raised position to allow any of the aggregate material 19 to be funneled directly into the intake end 41 of the slat conveyor.

FIG. 2 further shows at the front end 56 of the frame a truck push roll assembly 86. The truck push roll assembly 86 which is preferably used in conjunction with the material transfer machine 25 is a truck push roll assembly described and claimed in a patent application Ser. No. 07/448,055 filed on even date herewith by Jon D. Goodwin and Joseph E. Musil, entitled Vehicle Positioning Method and Apparatus With Impact Damper, which is assigned to the assignee of this application and is now U.S. Pat. No. 5,004,394. In reference to FIG. 1, the truck push roll assembly 86 has the ability of being extended or retracted over a suitable distance with respect to the leading edge of the hopper 46 to allow a rear edge 87 of the truck bed 20 to be more ideally located with respect to the hopper 46 on a truck by truck basis. It should be realized that rear axle to rear bed dimensions of supply trucks vary. Thus, without the ability to vary the distance between the front of the truck push roll assembly 86 and the leading edge 47 of the hopper, an ideal positioning of the truck bed 20 with respect to the hopper 46 may not be obtainable.

Figure 3:
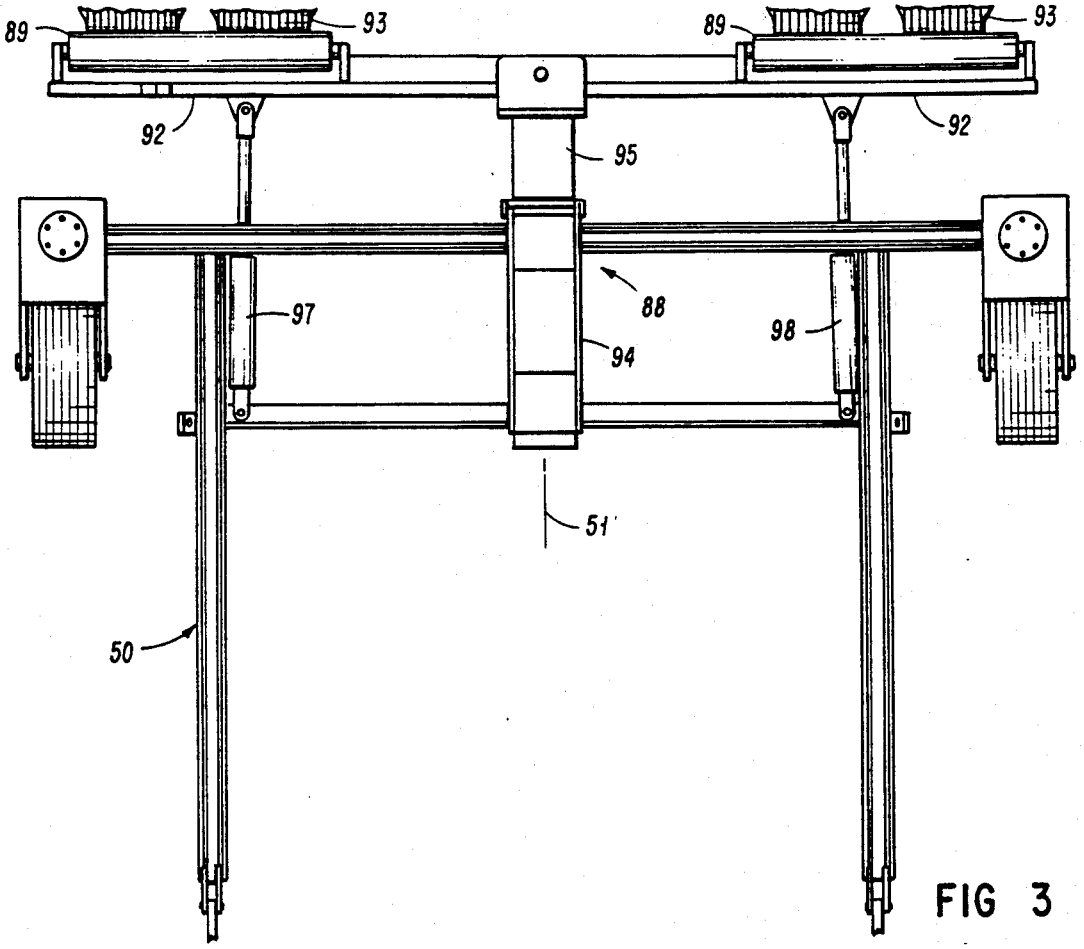
FIG. 3 is a simplified plan view of a support frame of the material transfer machine shown in FIGS. 1 and 2, highlighting support features of the frame.

Referring again to FIG. 2 and also to FIG. 3 in the further description of features of the truck push roll assembly 86, a push roll support and extension guide channel 88 is disposed at an angle declining downward from the horizontal toward the rear of the material transfer machine 25. The angle allows the guide channel 88 to be disposed below the center of the hopper 46 without interference with the lowermost position of the hopper. The inclined disposition of the guide channel 88 is slight and causes negligible vertical change in the position of truck rolls 89 of the assembly 86. The guide channel is disposed along the centerline 51 of the material transfer machine 25, as seen in the plan view of the support frame 50 in FIG. 3, allowing a typical centered pivot mount 90 of a cross beam 91. The cross beam 91 supports at each transversely outer end 92 one of the truck push rolls 89. The centered pivotable mount 90 of the cross beam 91 enables left and right hand truck rolls 89 to equally engage the respective left and right tires 93 of a truck should such truck back toward the material transfer machine at a slight angle.

The guide channel 88 includes an outer guide tube 94, preferably of rectangular cross section, and an inner guide member 95 which is free to slide in the longitudinal direction with respect to the tube 94 but is restrained from rotational movement about its longitudinal axis by a rectangular cross-sectional shape complementary to that of the outer guide tube 94. Left and right hydraulic cylinders 97 and 98 are conveniently powered by the pump and hydraulic system 69. As may be seen from the schematic hydraulic diagram in FIG. 5, the hydraulic cylinders 97 and 98 are extended and retracted simultaneously, but a cross feed connection in the hydraulic lines 72 between the two cylinders 97 and 98 support the free pivoting action of the cross beam 91.

The preferred truck push roll assembly 86 further provides an advantageous shock absorbing function. Such function has been found advantageous in alleviating an excessive force transmission of a sudden contact between truck tires 91 and the truck push rolls 89. It appears, that the shock absorbing function incorporated into the hydraulic cylinders 97 and 98 reduce the risk of causing a paving defect because of an inadvertently strong impact between the truck tires 93 and the truck push rolls 89.

Figure 4:
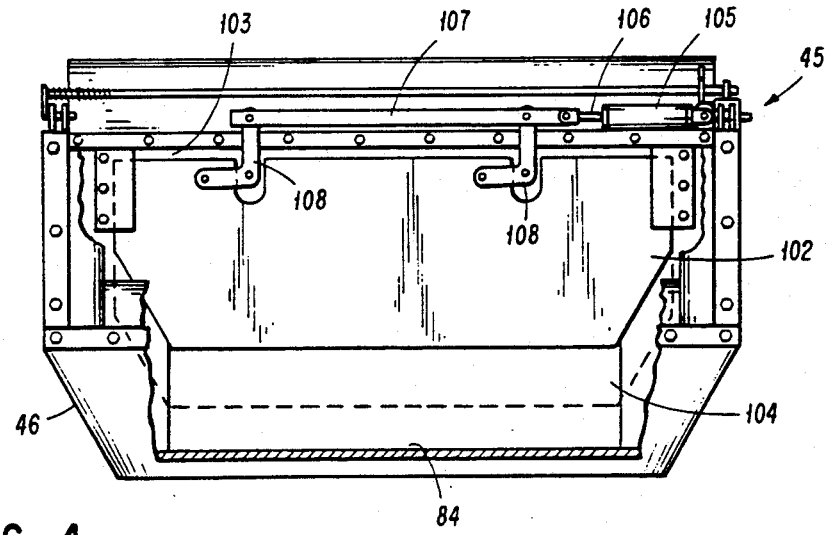
FIG. 4 shows a material flow control gate of a material dump hopper of the material transfer machine.

Referring to FIG. 4, the rearward view of the inside of the hopper assembly 45 shows a gate 102 which is slidably mounted along an upper wall 103 above a rear opening 104 above the rear pan 84 of the hopper 46. An upward and downward motion of the gate 102 is preferably controlled by a hydraulic cylinder 105 a piston 106 of which, by its extending rod, is coupled to a connecting bar 107. The connecting bar 107 operates first ends of a set of bell cranks 108, the second ends of which are coupled to the gate 102 to raise and lower the gate in response to a respective retractile or extensive movement of the piston 106 with respect to their respective cylinders 105.

The gate 102 has been found to be advantageous in controlling the material transfer from the hopper 46 to the feed hopper 18 of the paver 10. Slowing the transfer of the material 19 by decreasing the operational speed of the slat conveyor 36 tends to accumulate material 19 in the conveyor 36, and at a slower speed the elements of the conveyor 36 become more stressed to move the increased amount of material. In contrast, regulating the transfer of the material 19 by the position of the gate 102 allows the conveyor 36 to continue to operate at a constant speed, which type of operation appears to actually reduce the load on the components of the conveyor 36 to result in a decreased amount of required maintenance. The gate 102 may be raised or lowered by manual activation of a control valve 109 on a control board 110, as shown in FIG. 2, for example.

It is further contemplated to monitor the height to which the material accumulates in the feed hopper 18 by a sensor, such as an ultrasonic sensor 111, shown in reference to FIG. 1 mounted to the upper discharge end 42 of the conveyor 36. Such ultrasonic sensors 111 are state of the art detectors which are commercially available. In operation the sensor or detector 111 sends out an ultrasonic sound signal, not detectable by the human ear. The sound signal strikes the top of the material 19 in the hopper 18 and is reflected or echoed back from the material 19 to be received by the sensor 111. A timing and counting circuit determines the time interval between the transmission and reception of the ultrasonic signal. The time delay may then be translated into actual distance to determine the proximity of the top of the material 19 in the hopper 18 to the discharge end 42 of the slat conveyor 36.

In essence it is desirable to avoid the top of the material in the feed hopper 18 of the paver 10 to reach a level at which additional material can no longer be discharged from the conveyor 36. Should such a level be reached, the conveyor would clog and would likely become damaged in the process causing an interruption of the paving operation. Without feed control such a condition may be reached. A limiting example may be one in which, at the previously referred to exemplary paving speed of 60 feet per minute and a paving width of 14 feet, the paver 10 requires material 19 at a rate of approximately 14 tons per minute. If a truck were to discharge a supply of 20 tons into the hopper 46 and discharged material is transferred at a maximum transfer rate of the conveyor 36 to the feed hopper 18 of the paver 10, the material would be transferred over a period of 37 seconds into the feed hopper 18. If the feed hopper was substantially empty at the time of the transfer and has a capacity of approximately 15 tons, the hopper 18 should not be filled to its maximum capacity, but should remain essentially full at the end of the dump, allowing the next truck to continue to supply the paver with material.

However at a slower paving speed, a dump of a truck load of the material 19 would most likely transfer an excessive amount of material to the feed hopper 18. In such case the height of the gate 102 needs to be adjusted to decrease a maximum transfer rate of material 19 to the feed hopper 18. As described, that may be accomplished by an operator manually activating a valve which lowers the gate 102, as shown in FIG. 4. In the alternative, the ultrasonic sensor 111 may be employed to automatically adjust the flow rate to prevent the transfer of the material 19 at its maximum rate. In such case, the truck may need to remain backed against the front end of the material transfer machine for a few seconds longer until the bed 20 of the truck is empty and all material 19 has been transferred from the bed 20 to the hopper 46.

The hopper 46 in the preferred embodiment has a maximum capacity of no more than four tons of material. Thus, at the maximum transfer speed of the slat conveyor 36, the hopper 46 is empty shortly after a truck vacates the dump position at the front of the hopper 46. The subsequent truck may then begin dumping its supply of the material 19 as soon as it has backed against the truck push rolls 89.

It has been found, that in optimizing the speed of the paver, a weak link in the material supply chain is accessibility to trucks. Thus, even having in storage a spare capacity of an entire truck load of material, less than one and a half minutes of paving material are in reserve. Consequently, any delay by any of the trucks to reach a scheduled transfer point is likely to cause a stoppage in the paving operation with a resultant discontinuity in the pavement.

An advantage of the described direct truck dump material transfer apparatus lies in the reduction of the path between the truck and the paver 10. The hopper 46 functions as a guide to funnel the dumped material to the slat conveyor 36. The conveyor 36 has the capacity to transfer the material 19 at a sufficiently high rate to the feed hopper 18 of the paver 10 to support a continuous paving operation.

Another advantage has been found to reside in the use of the slat conveyor 36 for transferring the material 19 directly to the feed hopper 18 of the paver 10. Though the problem of material separation is recognized widely as a problem existing with asphaltic aggregate material, often a solution to totally preventing material separation does not exist. However, it has been found, that the described material transfer machine 25 minimizes material separation by minimizing or substantially eliminating gravitational expansion of the material 19 during any of the transfer steps occurring during the transfer of the material 19 from the bed 20 to the paving operation.

The transfer of the material from the truck occurs from an approximately nine foot wide bed to the hopper 46 just over ten foot wide to accept the width of the truck bed 20. From the hopper 46 the material is transferred to the paver 10 by the slat conveyor 36 which has a preferred width of 6 feet. This width is substantially the width of the beds of pavers, such as the paver 10. Consequently, the material 19 has little opportunity to separate because of gravitational separation of the aggregate. In investigating the cause of gravitational separation, it was discovered that flexible front and rear shields 113 and 114 limit gravitational separation as the material 19 falls from the discharge end 42 of the slat conveyor 36. As long as the feed hopper 18 of the paver is substantially empty, such as at the beginning of a material transfer, the front and rear shields 113 and 114 hang down substantially straight from front and rear edges 116 and 117 of the discharge opening at the discharge end 42 of the conveyor 36. As material 19 accumulates in the hopper 18 during the transfer operation, the accumulating material stacks itself against the inner surfaces of the front and rear shields 113 and 114, the shields by their presence preventing a free outward movement of material which has been found to promote material separation. The overall result of transfer by the material transfer machine 25 appears as a more uniformly mixed material as it is transferred by slats in the base of the feed hopper 18 to the rear of the paver 10 from where distribution occurs by means of the augers 22 in a conventional manner.

Figure 5:
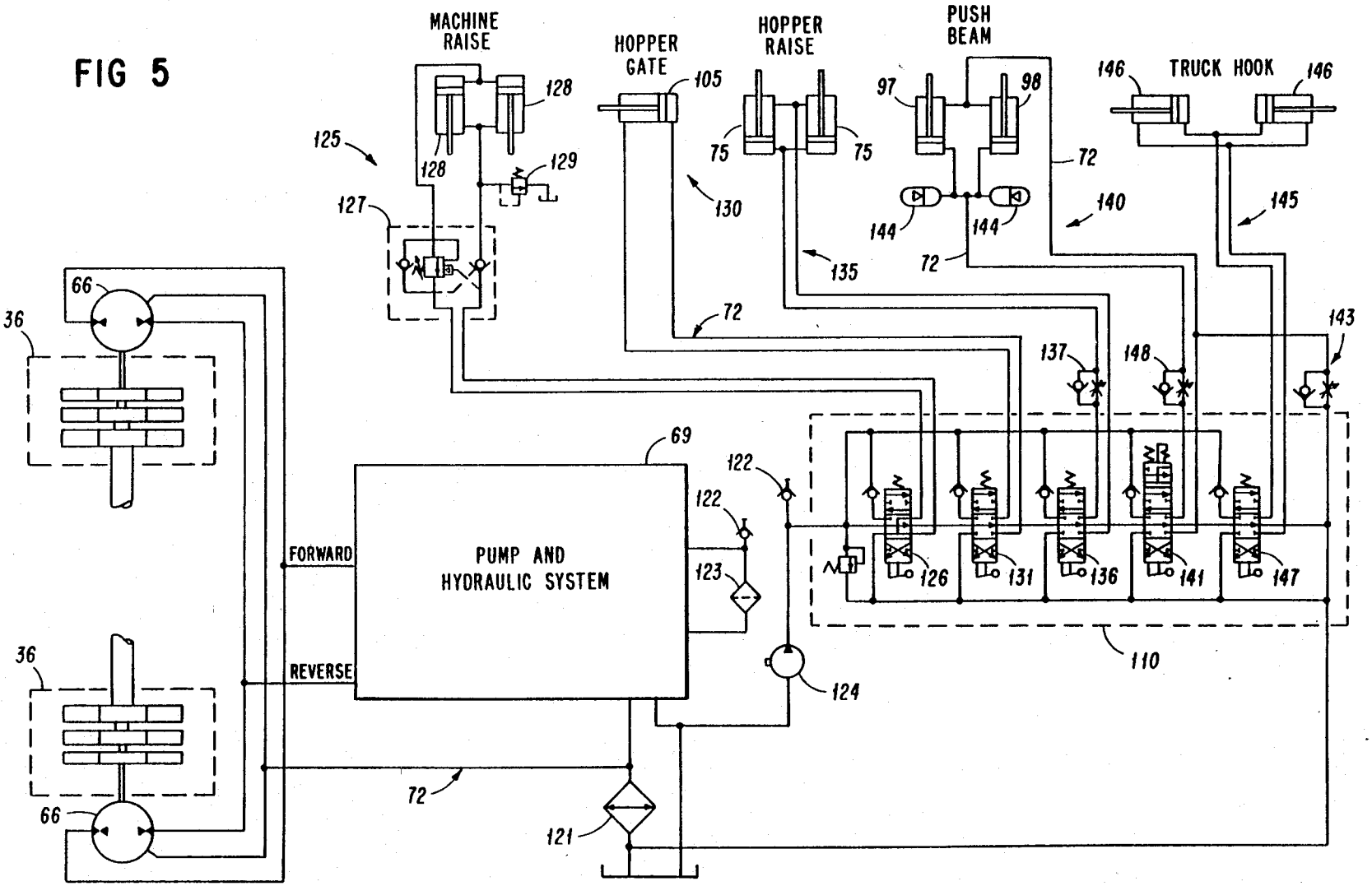
FIG. 5 is a schematic diagram of a hydraulic system for operating and controlling the material transfer machine in accordance with the invention.

Referring now to the schematic diagram of FIG. 5, the pump and hydraulic system 69 is shown to supply both forward and reverse direction flow lines to dual hydraulic motors 66 located at the discharge end of the slat conveyor 36. The upper return end 67 of the conveyor 36 also shows preferred speed reducers 120 which transmit the power in a typical manner from the motors 66 to the conveyor 36. The pump 69 is a typical, commercially available pump and hydraulic supply system, such as 90 series from Sundstrand Corporation. External hydraulic lines 72 include such standard system components as a heat exchanger 121, access points 122 and a filter 123. In addition to the hydraulic motors 66 for the conveyor 36, the diagram includes schematic descriptions of various previously described hydraulic circuits which may be activated by automatic means or such manually operated valves such as shown as part of the control panel 110. In the preferred embodiment, the various hydraulic circuits are powered by an auxiliary pump 124. The pump 124 may either be driven by the engine driving the hydraulic pump 69, as is preferred, or the pump 124 may be separately powered.

A first "Machine Raise" circuit 125 deserves special attention. In addition to such typical extending or retracting valve positions of an activating valve 126, the hydraulic circuit 125 further includes a positive lock 127 which functions in essence as a position hold of the circuit. The Machine Raise circuit functions in a preferred embodiment in a mode in which cylinders 128 are incorporated into the support and extension cylinders 80 to raise and lower the slat conveyor 36 of the material transfer machine 25 as previously described. A pressure relief valve 129 releases excess pressure in the system which may be occasioned by exposure to direct solar energy, for example.

The hydraulic circuit 130 includes an activation valve 131 which extends and retracts the cylinder 105 to lower and raise the gate 102. A preferred embodiment of the circuit 130 does not include a positive lock element as the Machine Raise circuit does.

The hydraulic circuit 135 is similarly operated by a three position activation valve 136 which has the capability of either extending or retracting action of respective hydraulic cylinders 75. Since the retraction of the rods of the cylinders lowers the hopper 46 as described with respect to FIG. 2, a check and needle valve combination 137 allows the downward movement of the hopper to be retarded. In each of the described activation valves 126, 131 and 136, the center position is a neutral position with both the extend and retract postions being spring-biased toward the neutral position. Consequently, an operator or an operating means, as in the case of an automatic operation, needs to positively operate the respective valve lever in order to achieve a result. A release of the lever allows the valve to return to the neutral position.

In addition to the two activation positions and the neutral position, a truck push roll circuit 140, as described in the above-referenced copending application to Goodwin and Musil, features an activation valve 141 which includes a fourth valve position 142 which is a "float" position. The float position will hold the set position of the truck push roll assembly 86 only when no force bears against the push rolls 89. When, however, a truck bears against the truck push rolls 89, slowly the position of extension may change, such that an operator may allow a truck to align its bed 20 with the hopper 46 of the material transfer machine 25 (see FIG. 1). When the alignment is achieved, the lever may then be returned to the neutral position of the valve 141. The special position is a detented position, such that the position may be established as an extended position, in which the push roll assembly 86 may remain until a truck backs toward the hopper 46. Each of the lines 72 to the cylinders 97 and 98 include a check valve 143 to relieve excess pressure which may have been admitted by sudden pressure increases when a truck backs against the push roller assembly 86. The shock absorbing function of the cylinders 97 and 98 is provided by an accumulator 144 which is charged to a preferred pressure of 200 psi.

The remaining circuit 145 is an optional circuit for activating a typical truck hook (not shown). The truck hook is not part of the preferred embodiment but may be included if desired as an option in accordance with structures already described herein. Truck hooks are known in the art and function in conjunction with state of the art truck push rolls. In accordance with the description herein, such a truck hook and the hydraulic cylinders 146 would be added adjacent the push rolls 89 at the outer ends 92 of the cross beam 91. Hydraulic cylinders 146 would be added to activate the truck hooks during the brief time of unloading the material 19 into the hopper 46 as shown in FIG. 1 The hydraulic cylinders 146 would then be retracted to release respective truck hooks. An activation valve 147 in such event is shown as a representative three position valve as for example the valve 131.

Various changes and modifications in the structure of the described embodiment are possible without departing from the spirit and scope of the invention as defined by the terms of the claims appended hereto including reasonable equivalents thereof.

What is claimed is:

1. A method of transferring material from a bed of a supply truck to a feed hopper of a road finishing machine comprising:

mounting a material transfer machine to a front end of the road finishing machine, with a discharge end of the material transfer machine disposed above a feed hopper of the road finishing machine;

dumping material from the bed of the supply truck into a hopper disposed at a front end of the material transfer machine;

transferring the material in a single transfer operation from the hopper at the front end of the material transfer machine to the discharge end thereof; and discharging the material by gravity into the feed hopper of the road finishing machine.

2. A method according to claim 1, wherein dumping material from the bed of a supply truck into a hopper comprises:

maneuvering the supply truck against a positioning means to position a rear edge of the bed above the hopper;

raising a front end of the bed to discharge the material from a rear end of the bed into the hopper;

supporting the weight of the discharging material against a support frame; and distributing the supported weight between front wheels mounted to the front of the support frame and a pivot mount attaching a rear of the support frame to an understructure of the material transfer machine.

3. A method according to claim 1, wherein transferring the material in a single transfer operation from the hopper at the front end of the material transfer machine to the discharge end thereof comprises:

guidingly directing the material along sloped sides of the hopper under the force of gravity to a lower intake end of a slat conveyor;

conveying the material from the lower intake end of the slat conveyor at an incline toward the discharge end at an opposite end of the slat conveyor; and controlling an amount of material guidingly directed to the lower intake end of the slat conveyor.

4. A method according to claim 3, wherein controlling the amount of material guidingly directed to the lower intake end of the slat conveyor comprises:

observing the amount of material discharged into the feed hopper of the road finishing machine and whether the amount of material discharged into the feed hopper approaches an upper limit; and adjusting a height of a gate mounted between a rear wall of the hopper for sliding movement to open and close an opening between a rear end of the hopper and the intake end of the slat conveyor.

5. A method according to claim 1, wherein discharging the material by gravity into the feed hopper of the road finishing machine comprises:

discharging the material at the discharge end of the material transfer machine from an upper end of a-slat conveyor through an opening at such discharge end; and engaging the discharged material with front and rear flexible shields depending from front and rear edges of said opening toward the hopper to limit free expansion of the material in the feed hopper by such engagement.

6. A method according to claim 5 further comprising: advancing the road finishing machine and the material transfer machine in joint movement along a base grade; and wherein the step of dumping comprises maneuvering the supply truck and the road finishing machine with respect to each other to position the supply truck against a positioning means and a rear edge of the bed above the hopper, raising a front end of the bed to discharge the material from a rear end of the bed into the hopper, supporting the weight of the discharging material against a support frame, and distributing the supported weight between front wheels mounted to a front of the support frame and a pivot mount attaching a rear of the support frame to an understructure of the material transfer machine.

* * * * *